US005727477A

United States Patent [19]

Kirkendall

[11] Patent Number: 5,727,477

[45] Date of Patent: Mar. 17, 1998

[54] REMOVABLE & STAWABLE COVER FOR TABLES

[75] Inventor: Timothy L. Kirkendall, Dayton, Ohio

[73] Assignee: E-Z Topper, Inc., Dayton, Ohio

[21] Appl. No.: 535,572

[22] Filed: Sep. 28, 1995

[51] Int. Cl.[6] ..... A47B 13/08

[52] U.S. Cl. ..... 108/90

[58] Field of Search ..... 100/90; 150/158; 16/225, 249, 257, DIG. 13

[56] References Cited

U.S. PATENT DOCUMENTS

| | | | |
|---|---|---|---|
| 1,332,776 | 3/1920 | Sultanaki | 108/90 X |
| 2,772,886 | 12/1956 | Parmele | 108/25 X |
| 2,809,466 | 10/1957 | Glover | 108/90 X |
| 2,954,635 | 10/1960 | Stotter | 108/90 X |
| 3,431,958 | 3/1969 | Justice | 108/90 X |
| 3,554,140 | 1/1971 | Homesberger | 108/90 |
| 3,785,419 | 1/1974 | Sherlock | 108/90 |
| 4,131,971 | 1/1979 | Saarloos | 16/DIG. 13 |
| 4,194,313 | 3/1980 | Downing | 16/225 X |
| 4,708,183 | 11/1987 | Figueros | 108/90 |
| 4,750,402 | 6/1988 | Markey | 108/90 X |
| 5,287,614 | 2/1994 | Ehrlich | 150/158 X |
| 5,474,185 | 12/1995 | Franke | 150/158 X |
| 5,487,690 | 1/1996 | Stoffle et al. | 16/225 X |

FOREIGN PATENT DOCUMENTS

| | | | |
|---|---|---|---|
| 270923 | 5/1969 | Austria | 150/158 |
| 400820 | 4/1966 | Switzerland | 16/225 |
| 828647 | 2/1960 | United Kingdom | 150/158 |
| 1063697 | 3/1967 | United Kingdom | 16/225 |

*Primary Examiner*—Jose V. Chen
*Attorney, Agent, or Firm*—Joseph G. Nauman

[57] ABSTRACT

This disclosure is directed to the use of rigid and semi-rigid materials to form a decorative covering device for standard folding banquet and convention tables. Through the use of a hinging mechanism on the front, rear and sides, this provides a device which can be folded up into an inside-out, flat configuration that can be easily transported and stored with minimal wear damage to its finished surfaces. The normally vertical front, rear and side sections of this device fold independently of one another into three different positions. Front, rear and side sections are a sandwich composition of plastic laminate and foam; the top section is a hardwood framework covered with a sandwich composition of plastic laminate and plywood. The first position of the sections is the operational position where the front, rear, and two side sections are deployed in a vertical position, hanging down from the top section, which rests upon the folding table. The second position is the storage-transport or stowed position where the front, rear and side sections fold out, up and onto the top upper surface and are secured, in order to reduce overall size of the covering device by changing it into flat configuration. The third position is an inactive position in which some of the deployed, normally hanging, sections (usually the rear and/or side sections) are folded in, up and under the top cover section, allowing for these sections to be positioned out of the way when they are not wanted, such as when it is desired to seat people at the table. These raised sections fold between the horizontal top cover and the top of the table on which the unit is placed.

16 Claims, 7 Drawing Sheets

FIG. 8
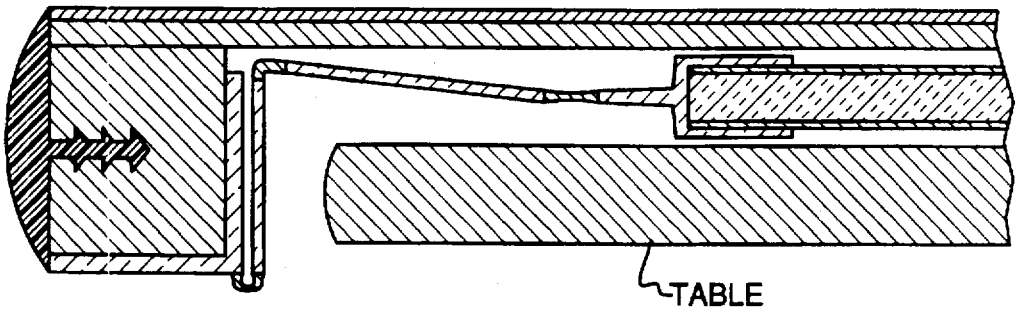
FIG. 9
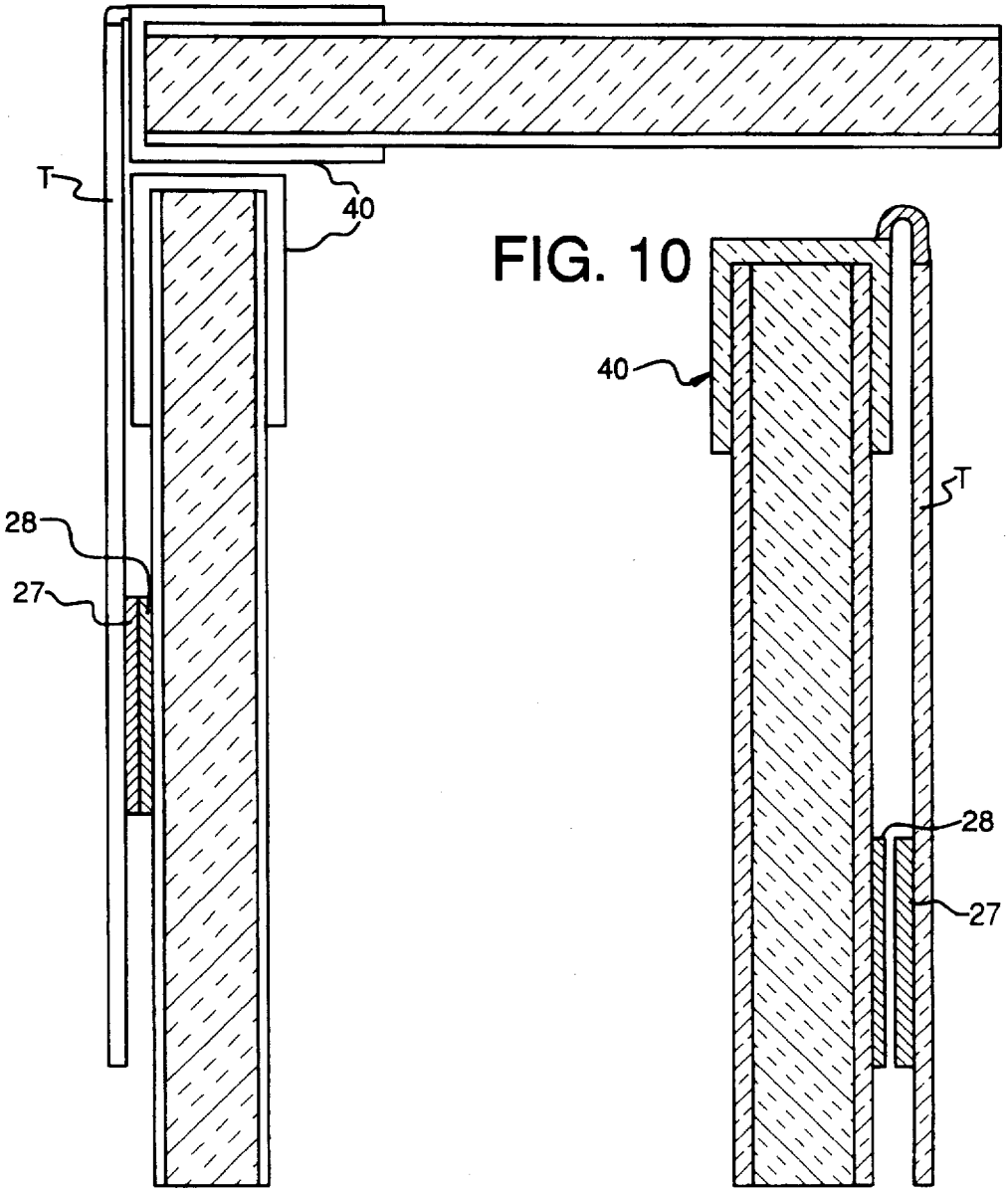
FIG. 10

REMOVABLE & STAWABLE COVER FOR TABLES

FIELD OF THE INVENTION

A unitary product constructed of rigid materials to be used in place of linens to cover and "dress" a folding banquet or convention table, in order to reduce long term table covering costs, reduce set-up and tear down labor costs and provide a more durable and aesthetically pleasing treatment.

BACKGROUND OF THE INVENTION

This invention relates to the covering of folding banquet and convention tables with a rigid foldable assembly in order to provide a decorative top and vertical hanging front, rear and sides (or combinations thereof). In the current industry e.g. at banquet centers, hotels, and convention centers or halls, this treatment is referred to as the "draping and skirting" of a folding table, where a linen tablecloth is placed over the table to cover the table top and a linen skirt is clamped over the top of the tablecloth to the edge of the table. This treatment then provides the draping and skirting, namely a decorative top and vertical front, rear and sides (or combinations thereof) for the conventional fundamental table.

In the past, these linen tablecloths and skirts provided a decorative treatment to folding tables but (1) easily soiled, (2) needed frequent laundering and/or dry cleaning, (3) faded when cleaned, (4) needed frequent replacement, (5) required extensive labor to set-up, (6) could move and/or unfasten during use, (7) did not provide a hard surface on which to write, (8) were not resistant to wind and moisture when used outdoors, (9) did not present a professional aesthetic appearance when used in a meeting, convention or trade show application.

There is a need, therefore, for a unitary product constructed of rigid materials to be used in place of linens to cover and "dress" a folding banquet or convention table, in order to reduce long term table covering costs, reduce set-up and tear-down labor costs, and to provide a more durable and aesthetically pleasing treatment.

SUMMARY OF THE INVENTION

This invention is directed to the use of rigid and semi-rigid materials to form a decorative covering device for standard folding banquet and convention tables. Through the use of a unique hinging mechanism on the front, rear and side sections, this invention provides a device which can be folded up into an inside-out, flat configuration that can be easily transported and stored with minimal wear damage to the exposed finished surfaces. The vertical front, rear and side sections of this product fold independently of one another into three different positions.

The first position of the sections is the operational or primary functional position where the front, the rear, and the two side sections are deployed in a vertical position, extending (hanging) down from the central top section or cover, which rests upon the folding table. The second position is the storage-transport or stowed position where the front, rear and two side sections fold out, up and onto the top upper surface and are secured, in order to reduce the overall size of the covering device and to change it into a flat configuration. By folding the front, rear and two side sections in over the top surface in this manner, the exposed finished surfaces are protected from wear damage during transporting and storing of this product.

The third position is the "out of the way" or inactive position in which some of the deployed, normally hanging, sections (usually the rear and/or side sections) are folded in, up and under the top cover section, allowing for these sections to be positioned out of the way when they are not wanted, such as when it is desired to seat people at the table. These raised sections fold between the horizontal top cover and the top of the table on which the unit is placed.

It is a further feature of this invention that the rear and front sections have tabs along their vertical sides (when hanging) that can be placed in three positions. First, the tabs can be folded over the storage position, and secured with fasteners, to hold the folded togather sections. When the devices are used on adjacent tables, the second function of these tabs is to cover the space formed when two table coverings are placed upon side by side tables. In this application, the tabs fasten together with hook and loop fasteners placed on the front of one flap and the rear of the other flap. The third function of these tabs is also to cover the space between two table coverings when the tables are placed perpendicular to one another. In this third application a tab functions by itself to fill the space between the two tables.

The rigid material used on the front, rear and sides sections of this invention is a sandwich composition of plastic laminate and foam, while the top is a hardwood framework covered with a sandwich composition of plastic laminate and plywood, with a plastic bumper molding around the outside edge.

Therefore the objects of this invention are to reduce long term costs of table coverings, to reduce labor required to set up and tear down, to produce a more professional appearance in meetings, conferences, or at trade show and sporting events, to eliminate laundering and dry cleaning costs, to provide a table covering with a hard writing surface, to provide a table covering that can be used outdoors, to provide a table covering with a selection of over one hundred colors, to provide a vesatile table covering where unneeded side section can be "stored" without affecting the esthetics or functionality of the table covering, to provide a table covering that is resistant to soiling and fading and to provide a table covering that will not move or fall off during use.

Other objects and advantages of the invention will be apparent from the following description, the accompanying drawings and appended claims.

BRIEF DESCRIPTION OF THE DRAWINGS

FIG. 8 is an enlarged and broken partial cross-sectional view showing the hinge function when certain sections are folded under as shown in FIG. 7;

FIG. 9 is a side view with sections fully deployed, showing the connection between the front, side and rear sections;

FIG. 10 is an enlarged cross-sectional view of the tabs in a non-use position;

DESCRIPTION OF THE PREFERRED EMBODIMENT

This invention provides a decorative covering device for standard folding banquet and convention tables. Through the use of a hinging mechanism on the front, rear and sides, this unique cover device can be folded into an inside-out, flat configuration that can be easily transported and stored with minimal wear damage to the exposed finished surfaces. The vertical front, rear and side sections of this device also fold independently of one another into three different positions.

Figure 5:
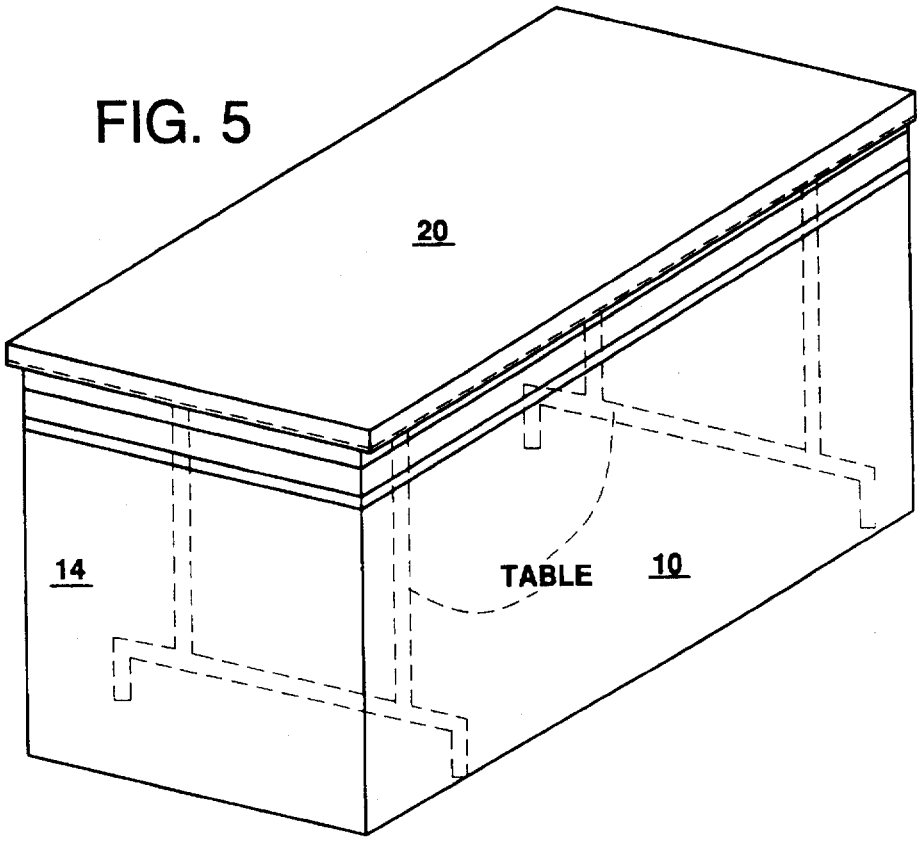
FIG. 5 is a perspective view showing all sections fully deployed, with the tabs omitted.

The first position is the operational fully deployed position, as in FIG. 5, where the front 10, the rear 12, and the two side sections 14, 15 are deployed in a vertical position, extending down from the central top surface or cover, which rests upon the folding table top. The top section 20 includes a hardwood frame 20F (FIG. 6), to which is secured, by hinge mechanisms, composite sandwich-like panel 10P, 12P, 14P, 15P and 20P. These panels have a rigid foam core 10C, 12C, 14C, and 15C of substrate, e.g. 3/16 inch thick Gator Foam (trade name), an outer decorative surface layer bonded to the core, and an inner surface layer bonded to the core. However, the core 20C for top panel 20 is a ¼ inch plywood, instead of foam, to provide an impact resistant panel.

The decorative surface layers 10-L, 12-L, 14-L, 15-L and 20-L may be a composite sheet of pressure formed laminate (e.g. Formica) having a selected finish of wood grain, solid colors, or various patterns, which are known and commercially available. The inner surface layers, 10-I, 12-I, 14I and 15-I may be a similar composite sheet of pressure formed laminate having a dark (black or brown) solid color finish.

Figure 1:
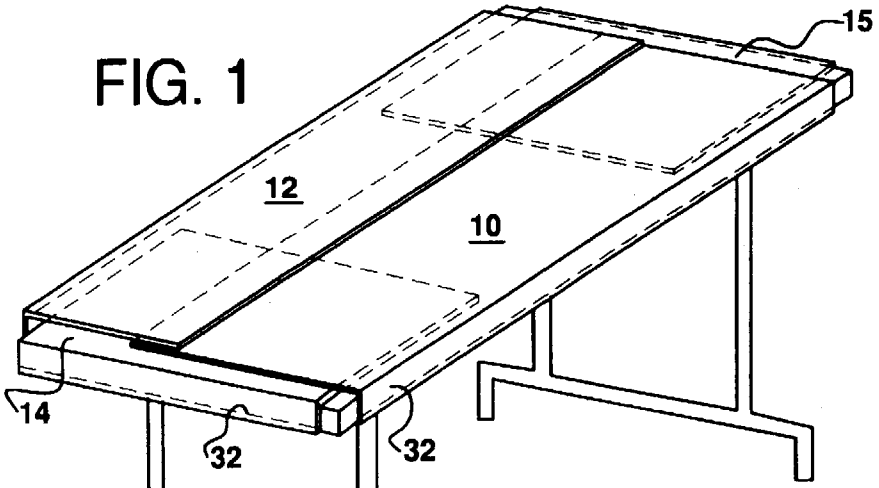
FIG. 1 is a perspective view of a typical table, with the decorative cover device thereon in a stowed position.
Figure 2:
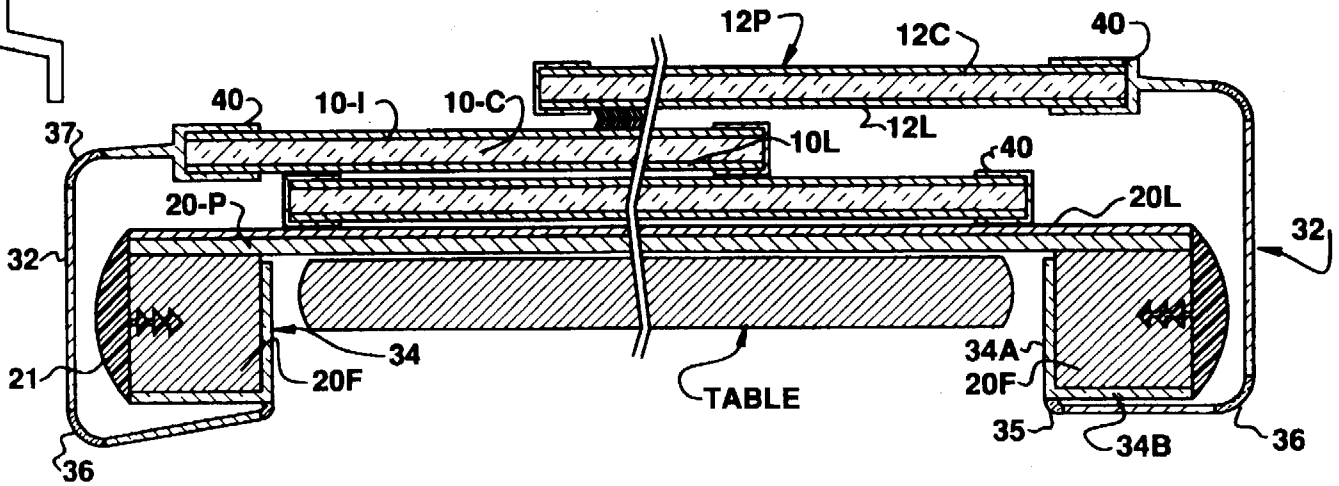
FIG. 2 is an enlarged and broken cross-sectional view through the device with the sections in stowed position, before removal from a table.
Figure 3:
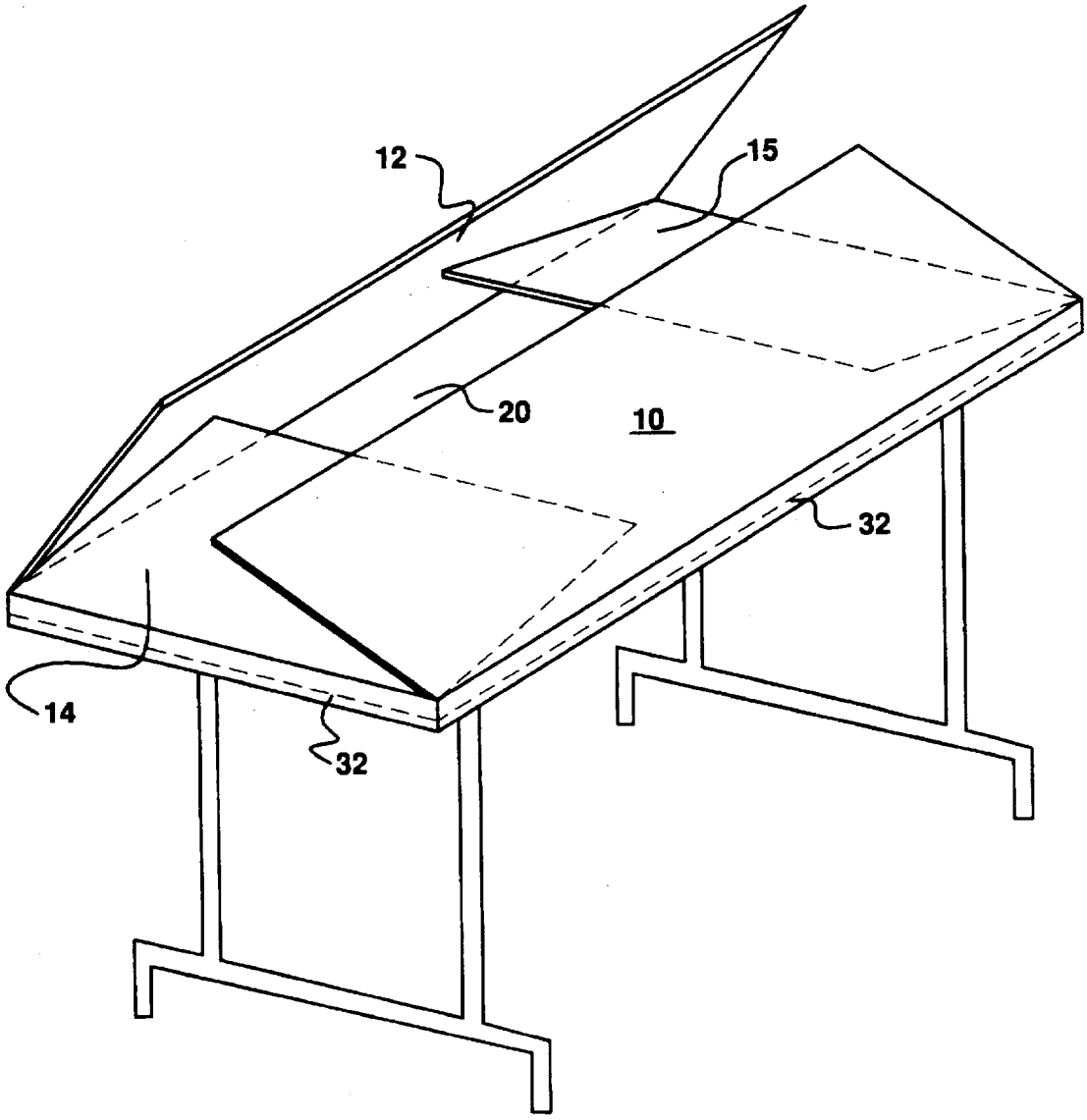
FIG. 3 is a perspective view similar to FIG. 1, showing the front and rear sections partially moved toward the deployed position.
Figure 4:
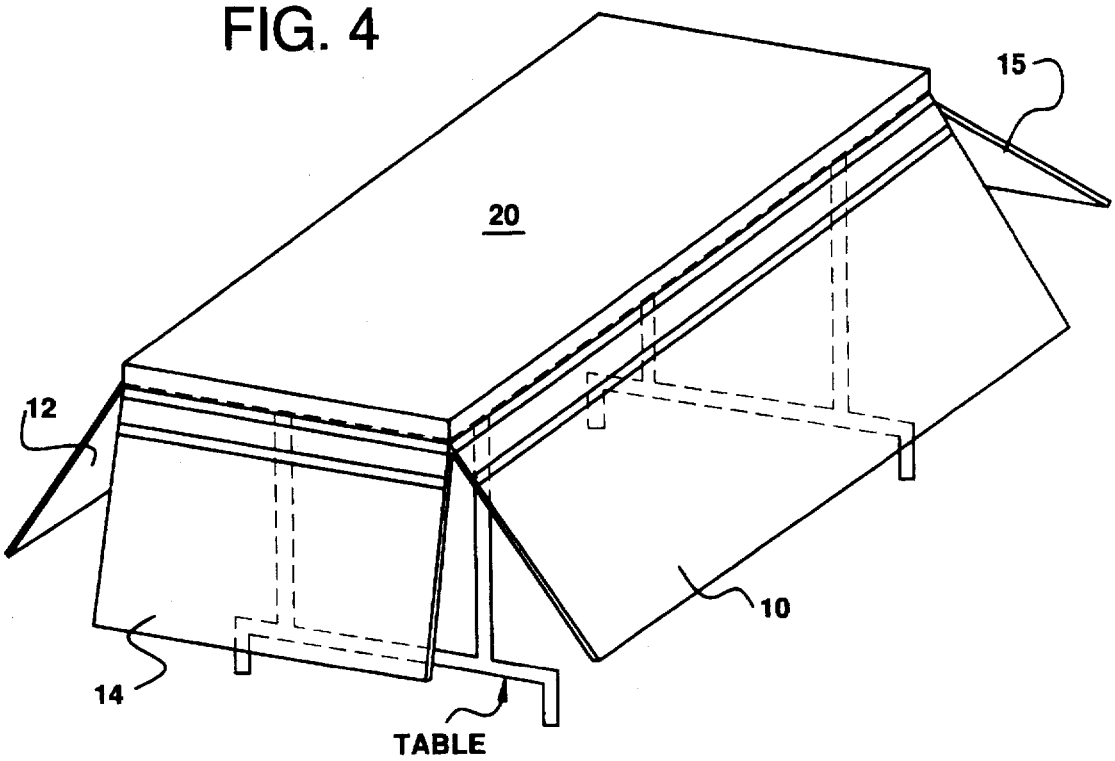
FIG. 4 is a perspective view similar to FIG. 1, showing the front, rear, and side sections folded out to near fully deployed positions.

Conventional bumper, strips 21 of T-shaped rubber or plastic can be added about the perimeter of the top section if desired.(see FIG. 2).

The second position of these sections is the stowed or "storage-transport" position (FIG. 2) where the front, rear and two side sections fold out, up and onto the top surface of the top cover panel 20 and are secured, in order to reduce the overall size of the device and to change it into a flat configuration. By folding the front, rear and two side sections in over the top panel upper surface in this manner, the exposed finished surfaces are protected from wear damage during transporting and storing of this device.

Figure 7:
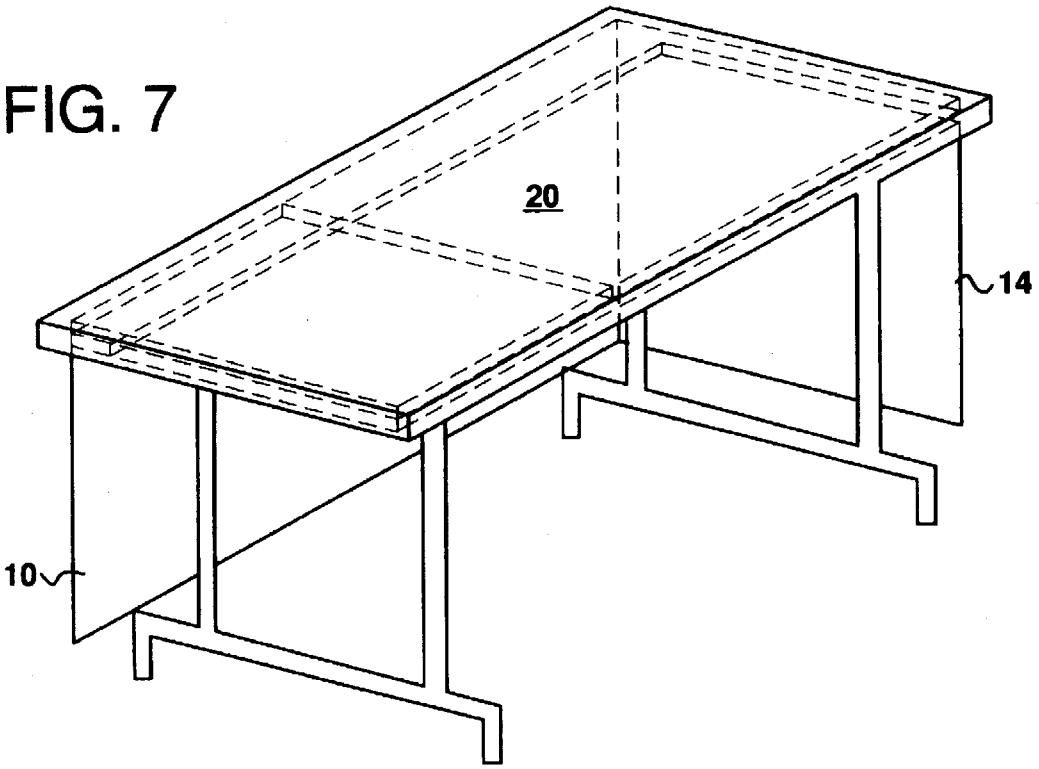
FIG. 7 is a perspective view with the front and one side section deployed, and the rear and other side section folded under the top section in the non-use position.

A further position or positions of these sections is the "out of the way" or non-use position in which some of the deployed, normally hanging, sections (usually the rear and/or side sections) are folded in, up and under the top panel lower surface, allowing for these sections to be positioned out of the way when they are not wanted, such as when it is desired to seat people at the table. These raised sections fold between the horizontal top cover and the top of the table on which the unit is placed (FIG. 7).

It is desirable that the rear and front sections 12 and 10 have tabs 12T and 10T (FIG. 9 and 10) along their vertical sides, movable into three positions. The first function of those tabs is to attach the two side sections 14, 15, to rear and front sections.

Figure 11:
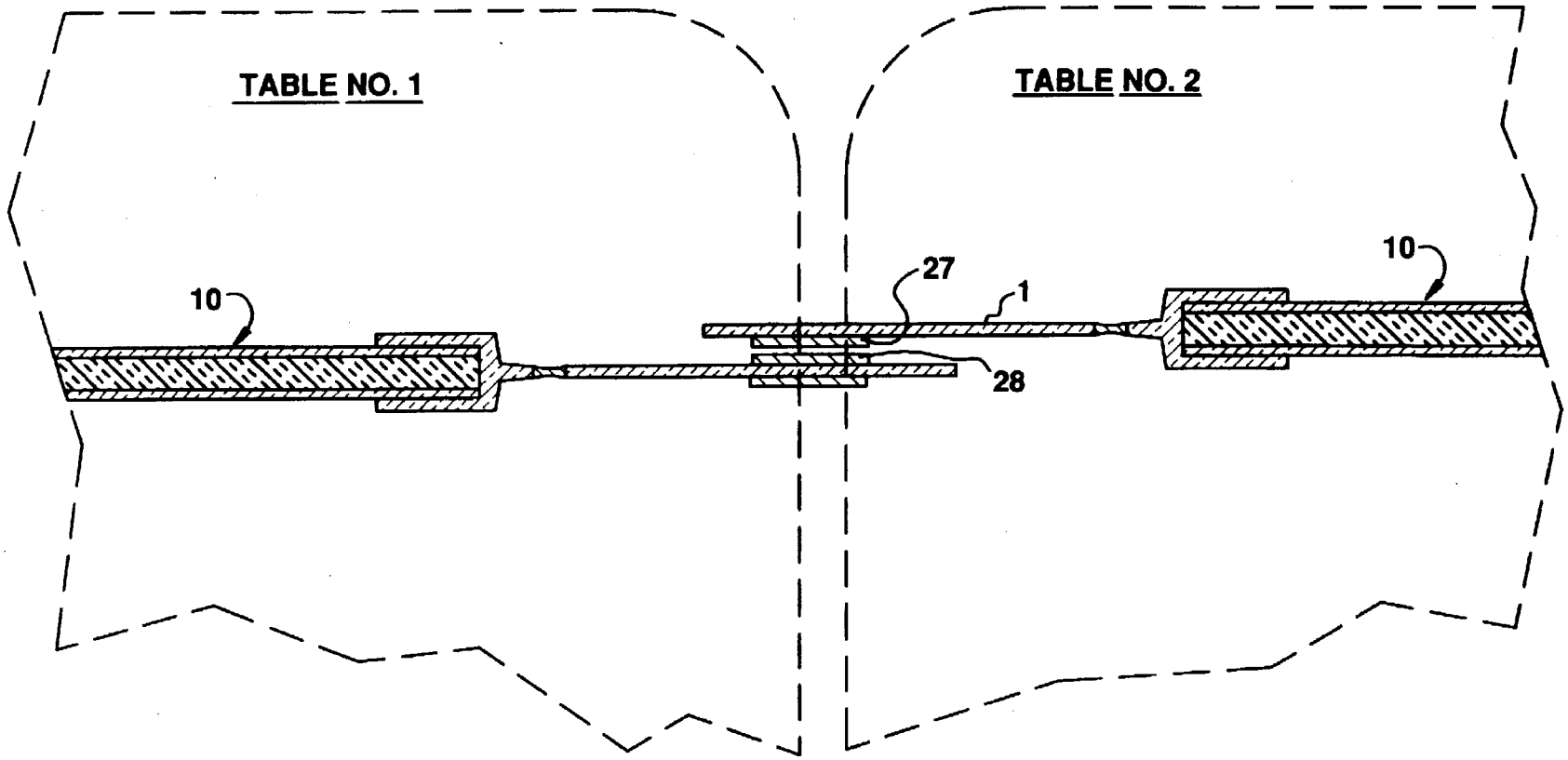
FIG. 11 is a view showing overlapped end panels of two cover devices on adjacent, in line, tables, with their tabs jointed by hook and loop fasteners.
Figure 12:
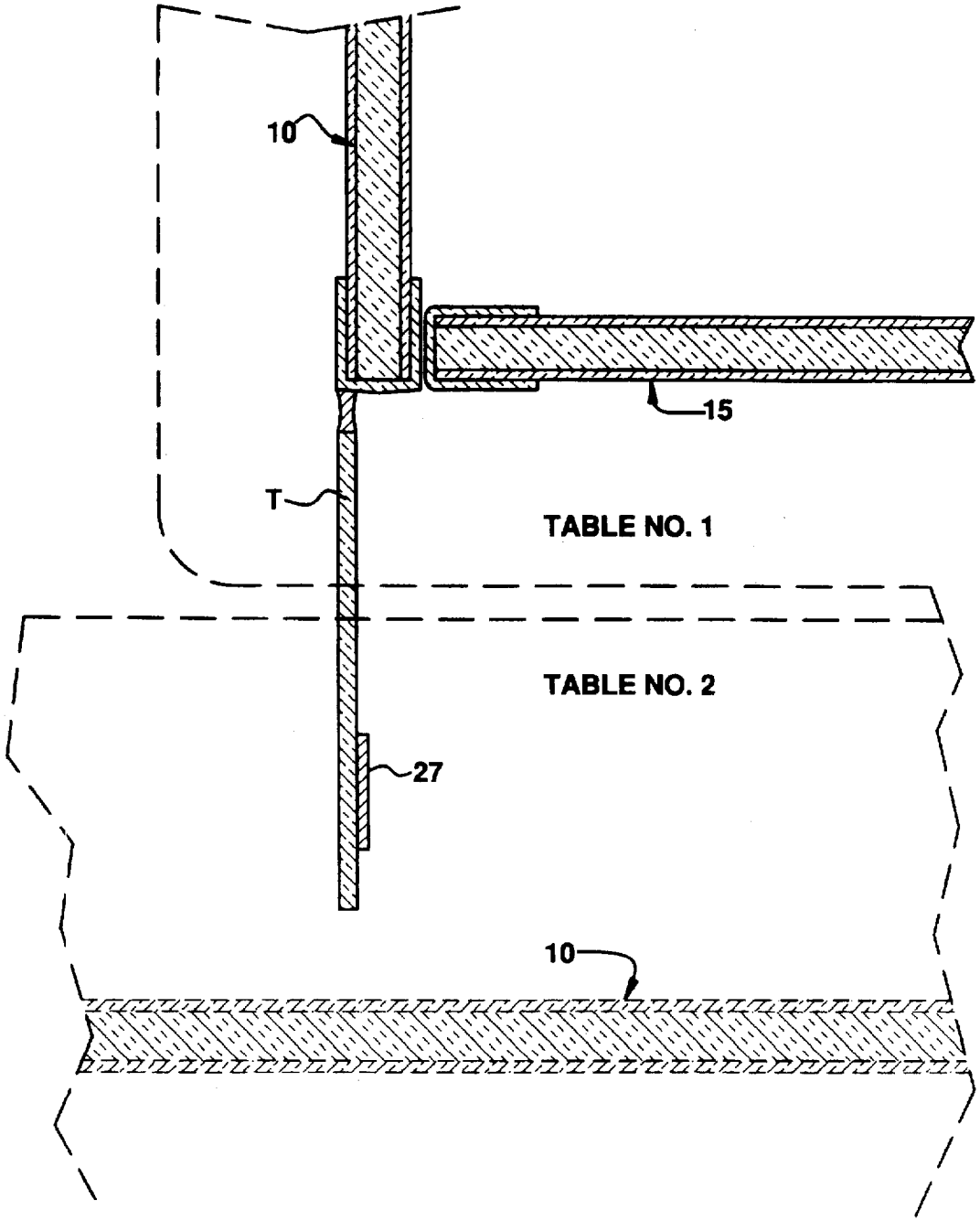
FIG. 12 is a view illustrating the use of tabs and hook and loop fasteners to hold sections in place when the devices are used on tables positioned perpendicular to each other.

When the device is in the operational position (FIG. 9) the second function of tabs T is to cover the space formed when two table cover devices are placed on side by side tables (FIG. 11). In this application, the tabs T can fasten together with hook and loop fasteners 27, 28 placed on the front of one tab and the rear of the other tab. These tabs also can cover space between two table cover devices when the tables are placed perpendicular to one another (FIG. 12). In this application a tab can function by itself to fill the space between the two tables.

Hinge Mechanism

The sections of the unit are attached to each other by unique triple-jointed hinge mechanisms 30, as shown in FIGS. 2, 6, 8 and 9, formed of a continuous strip of suitable plastic material 32. At one edge of such strip there is a frame attachment section 34 formed as perpendicular parts 34A, 34B which are dimensioned to fit against the frame 20F and to be secured thereto by a suitable adhesive.

In strip 32 there are formed continuous integral hinges at three different locations. These hinges are made by co-extrusion, using a flexible plastic (e.g. vinyl)in the hinge regions. The first hinge 35 is adjacent attachment section 34, the next lower hinge 36 is approximately midway the width of strip 32, and the third hinge 37 is located adjacent the opposite edge of strip 32, where a panel attachment channel 40 is formed of integral parallel legs spaced to receive an edge of the composite panels of sections 10, 12, 14 and 15. The respective panels are secured to the integral hinge member by suitable adhesive.

Figure 6:
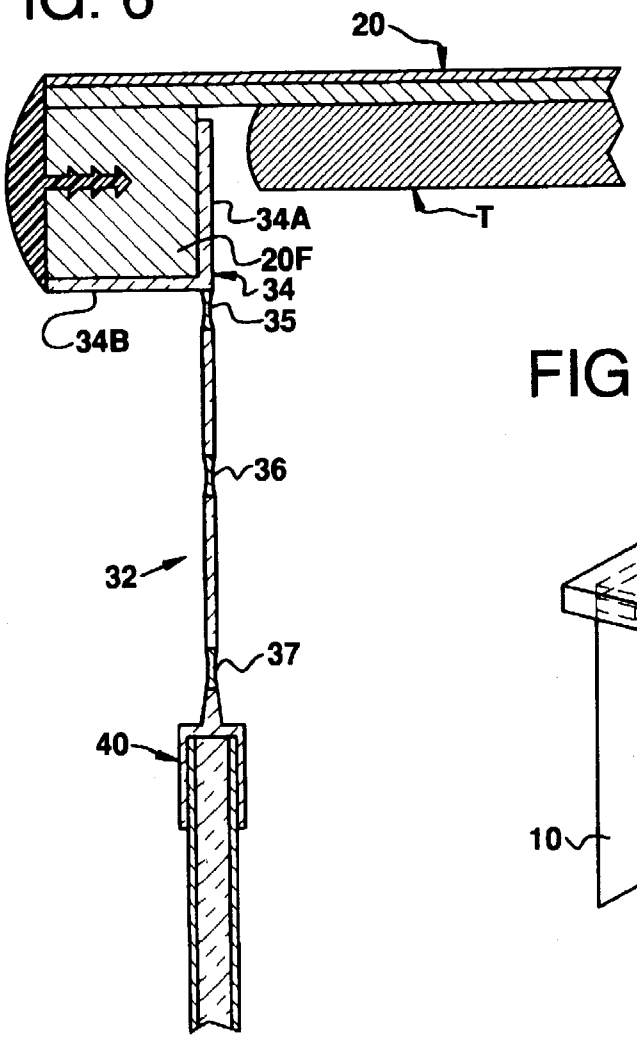
FIG. 6 is an enlarged and broken cross-sectional view, similar to FIG. 2, showing a section hanging from the top section in fully deployed position.

Thus, the strip can hinge close to the frame (see FIG. 2), at a location midway its width, and also close to the attached panel. Therefore, the attached sections can hang from the top section frame 20F (FIG. 6) or move to the various locations previously described, and as shown in FIGS. 5, 6 and 7, so the sections can be selectively deployed as the occasion may demand.

While the forms of apparatus disclosed constitute preferred embodiments of this invention, it is to be understood that the invention is not limited to these precise forms of apparatus, and that changes may be made in either without departing from the scope of the invention, which is defined in the appended claims.

What is claimed is:

1. A decorative cover device for banquet and like tables, comprising a substantially rigid top section having front, rear, and side edges and having an upper and a lower surface, said top section being sized to fit totally over a standard table top in a horizontal orientation, a substantially rigid separate front section including top, side and bottom edges, said top edge of said front section having a first hinged connection to said front edge of said top section to hang said front section from said top section deployed in a vertical position, substantially rigid side sections including top, side, and bottom edges, said top edges of said side sections having additional hinged connections to said side edges of said top section to hang said side sections from said top section deployed in a vertical position, said front section being movable to a stowed position against said upper surface of said top section when the cover device is removed from the table top, said hinge connections being an integral elongated flexible hinge member attached to said front and side edges of said top section and to said top edges of said front section and said side sections, said hinge connections being an integral elongated plastic strip having attachment edges along the longer sides of each said strip, a) fastening channels at the attachment edges of said strips for attachment to said top section and to the top edges of said front section and said side sections, and b) a flexible hinge strip formed in and extending along said plastic strip intermediate said attachment edges defining the hinge location between said top section and the other sections.

2. A decorative cover device as defined in claim 1, further comprising substantially rigid side sections each having top, side and bottom edges, second and third hinged connections between said top edges of said side sections and said side edges of sais top section to deploy said side sections hanging vertically from said side edges of said top section.

3. A decorative cover device as defined in claim 2, wherein said side sections are movable about said second and third hinged connections to a stowed position above and parallel to said upper surface of said top section.

4. A decorative device as defined in claim 2, further including interlocking means between said side sections and said front sections for joining said front and side sections in their deployed position.

5. A decorative device as defined in claim 1, further comprising said hinge connections being an integral elongated flexible hinge member attached to said front and side edges of said top section and to said top edges of said front section and said side sections.

6. A decorative cover as defined in claim 1, including two parallel hinge strips formed in said plastic strip allowing other sections to fold into superposition over said upper surface of said top section.

7. A decorative cover as defined in claim 1, wherein said sections include a core member and a decorative pressure laminate on said core member providing a stiff hard decorative surface.

8. A decorative cover as defined in claim 7, wherein said top section includes a frame attached to its said lower surface, said frame having interior dimensions to fit around the top of a table.

9. A decorative cover device for banquet and like tables; comprising a substantially rigid rectangular top section having front, rear, and side edges and having an upper and lower surface, said top section being sized to fit over a standard table top in a horizontal orientation and extending beyond the edges of the table top, a substantially rigid separate rectangular front section including a top edge and having a first hinge connection to said front edge of said top section to hang said front section from said top section deployed in a vertical orientation, said front section being movable to a stowed position against said upper surface of said top section when the cover device is removed from the table top, said first hinge connection being an elongated plastic strip having a) fastening channels at the lengthwise edges of said strip for attachment to said top section and to said front section, and b) a flexible hinge strip extending the length of said plastic strip defining the hinge location between said top section and said front section.

10. A decorative cover device as defined in claim 9, further comprising rectangular side sections each having a top edge and each having separate hinge connections to said top section.

11. A decorative cover device as defined in claim 10, wherein said side sections are movable to a stowed position above and parallel to said upper surface of said top section.

12. A decorative device as defined in claim 10, further including interlocking tabs extending from said front and rear sections and having optional attachments to said side sections.

13. A decorative device as defined in claim 10, further comprising said first hinge connection and said separate hinge connections each being an integral elongated flexible hinge member attached respectively to said front and side edges of said top section and to said top edge of said front section and said side sections.

14. A decorative cover as defined in claim 9, also including at least two hinge strips formed in said plastic strip allowing said front section to fold into superposition over said upper surface of said top section.

15. A decorative cover as defined in claim 14, wherein said sections include a core member and a decorative pressure laminate on said core member providing a stiff hard decorative surface.

16. A decorative cover as defined in claim 15, wherein said top section includes a frame attached to its said lower surface, said frame having interior dimensions to fit around the top of a table.

* * * * *